US008836471B2

(12) United States Patent
Neubauer et al.

(10) Patent No.: US 8,836,471 B2
(45) Date of Patent: Sep. 16, 2014

(54) USE BLOCK FOR A HANDHELD WORK APPARATUS

(75) Inventors: Andreas Neubauer, Ludwigsburg (DE); Robert Böker, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 184 days.

(21) Appl. No.: 13/311,200

(22) Filed: Dec. 5, 2011

(65) Prior Publication Data

US 2012/0139692 A1 Jun. 7, 2012

(30) Foreign Application Priority Data

Dec. 6, 2010 (DE) ..... 10 2010 053 584

(51) Int. Cl.
*G08B 21/00* (2006.01)
*B25F 5/00* (2006.01)

(52) U.S. Cl.
CPC ..... *B25F 5/00* (2013.01)
USPC ..... 340/5.2; 340/5.21; 340/5.3; 340/5.31; 340/5.8; 726/2

(58) Field of Classification Search
USPC ..... 340/5.2, 5.21, 5.3, 5.31, 5.8; 726/2
See application file for complete search history.

(56) References Cited

U.S. PATENT DOCUMENTS

| | | | | |
|---|---|---|---|---|
| 7,982,624 | B2 * | 7/2011 | Richter et al. | 340/626 |
| 2003/0107470 | A1 | 6/2003 | Kady | |
| 2005/0248303 | A1 * | 11/2005 | Garcia et al. | 318/480 |
| 2005/0248893 | A1 * | 11/2005 | Anderson | 361/78 |
| 2006/0179473 | A1 * | 8/2006 | Innami et al. | 726/2 |
| 2008/0236220 | A1 * | 10/2008 | Calvet et al. | 70/263 |

FOREIGN PATENT DOCUMENTS

DE 100 29 138 A1 1/2002

* cited by examiner

*Primary Examiner* — Mahammad Ghayour
*Assistant Examiner* — Mark Rushing
(74) *Attorney, Agent, or Firm* — Walter Ottesen P.A.

(57) ABSTRACT

The invention relates to a portable handheld work apparatus such as a cutoff machine, motor-driven chain saw, brushcutter, blower apparatus or the like. The apparatus includes a drive motor (2) for driving a work tool (6) and is provided with a security circuit (20). The security circuit (20) switches the drive motor (2) of the work apparatus into an operational-ready state or into an out-of-service state in dependence upon received signals of a receiver unit (18). The receiver unit is configured to receive at least one operating code. The receiver unit (18) is configured for receiving a service code (27) and, with the receipt of a service code, switches the drive motor into only a temporary service state.

11 Claims, 1 Drawing Sheet

USE BLOCK FOR A HANDHELD WORK APPARATUS

CROSS REFERENCE TO RELATED APPLICATION

This application claims priority of German patent application no. 10 2010 053 584.2, filed Dec. 6, 2010, the entire content of which is incorporated herein by reference.

FIELD OF THE INVENTION

The invention relates to a handheld work apparatus and especially to a portable handheld work apparatus such as a cutoff machine, motor-driven chain saw, brushcutter, blower or the like.

BACKGROUND OF THE INVENTION

German patent publication 100 29 138 A1 discloses a use block for an electric tool which has a read unit in the form of a transmission and receiving unit in the housing of the work apparatus. The transmission and receiving unit communicates with a transponder carried by a user. For an unauthorized taking into service, there is an intervention in the work apparatus by means of a safety circuit in such a manner that the motor cannot be taken into operation.

If such an apparatus needs servicing, the transfer of the personal transponder of the user to the service facility is regularly necessary. Only then is the service technician in the position to take the work apparatus into service.

Basically, it is also known to use master transponders which are usable as master keys for an entire group of apparatus. If one master transponder of this type is stolen, the use block of a plurality of apparatus is useless.

SUMMARY OF THE INVENTION

It is an object of the invention to provide a use block for work apparatus which achieves a high standard of safety.

The portable handheld work apparatus of the invention includes: a work tool; a drive motor for driving the work tool; a receiver unit configured to receive a service code and for outputting a signal; a security circuit for switching the drive motor into an operational-ready state for an operation or into an out-of-service state; the receiver unit being configured to receive a service code including a permissible service code; and, the security circuit being configured to switch the drive motor into a temporary service state in response to the receiver unit receiving the permissible service code.

The receiver unit, which is provided for receiving and operating code, is, according to the invention, simultaneously configured to receive a service code in order to temporarily switch into a service state when receiving a service code via the security circuit. Even when there is an unauthorized taking of a use card with a service code, the user can only work temporarily with the machine.

In a further embodiment of the invention, a counter, which is arranged in the work apparatus, is incremented. The security circuit switches the drive motor into a permanent out-of-service state when a pregiven counter count is reached. The out-of-service state is only disabled via the receiving of an operating code. Even when a user has unauthorizedly acquired the service code or a corresponding identity card, this person cannot continue to use the apparatus in service after reaching a pregiven counter count. Only the authorized user, who has an identity card having the authorized operating code, can continue to use the apparatus.

The pregiven counter count is selected as being less than 5 and is especially less than 3 in order to have sufficient possibilities for testing the machine during service.

It is provided that the receiver unit resets the counter for each receipt of an operating code.

It is practical that the service state and the operationally-ready state of the work apparatus are the same. In the out-of-service state, the drive motor can be driven at a significantly reduced rotational speed and/or power.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
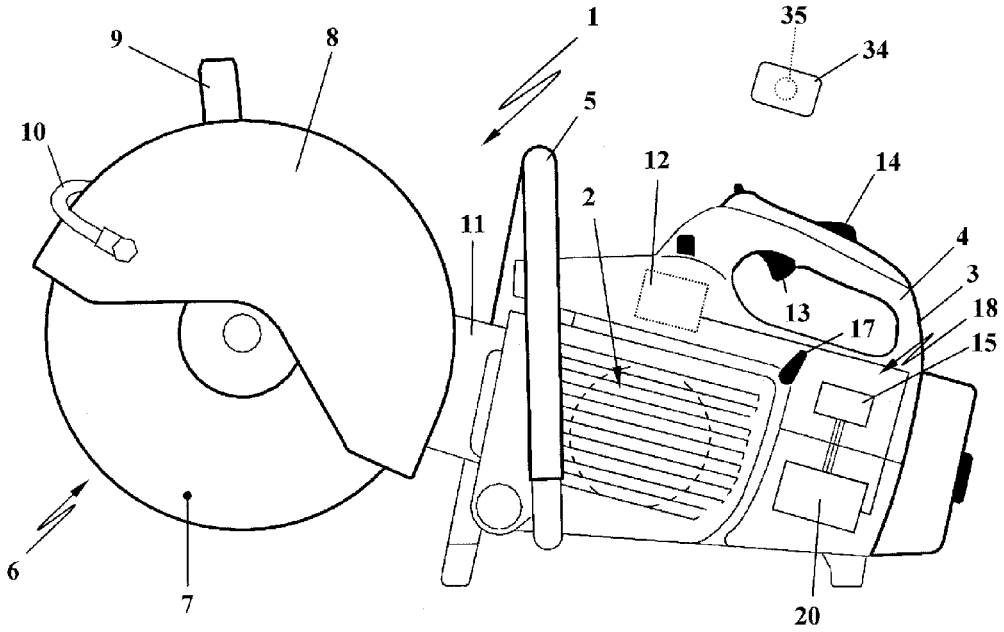
FIG. 1 is a schematic of a handheld work apparatus in the form of a cutoff machine by way of example; and, FIG. 2 is a schematic function diagram of a security circuit integrated into the work apparatus of FIG. 1.
Figure 2:
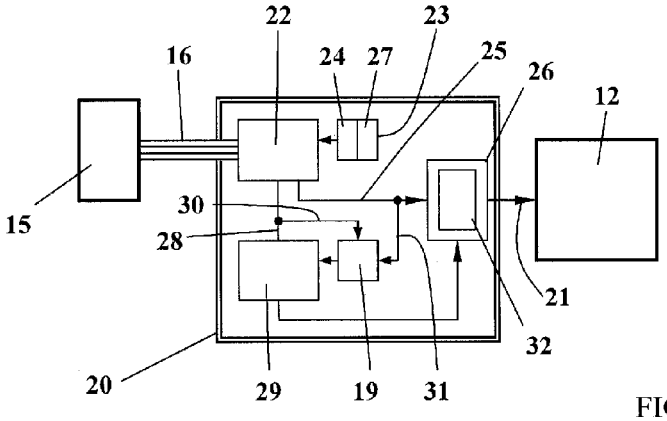

The cutoff machine 1 shown in FIG. 1 is provided as a general example of a portable handheld work apparatus. The work apparatus could also be a motor-driven chain saw, a brushcutter, a blower apparatus, a spray apparatus or the like.

The work apparatus, namely, the cutoff machine 1, includes a drive motor 2 which can be a combustion engine or an electric motor. The drive motor 2 is built into a housing 3 of the work apparatus. The housing 3 has an upper operating handle 4 aligned in the longitudinal direction of the work apparatus. A bale handle 5 is disposed ahead of the operating handle 4. The drive motor 2 drives a work tool 6 which, in the embodiment shown, is a cutting disc 7.

The cutting disc 7 is covered by a protective hood 8 which includes an adjusting knob 9. A water feed 10 is provided on the protective hood 8 on both sides of the cutting disc 7. The dust, which arises during work, is bonded by means of the water feed 10. The cutting disc 7 with the protective hood 8 is held on an outrigger 11 wherein the drive belt runs for the rotating cutting disc 7.

In the embodiment shown, the drive motor 2 is a combustion engine to which a control unit 12 is assigned. The control unit 12 controls the combustion engine according to an apparatus-specific operating characteristic field. As a practical matter, the control unit determines the composition of the air/fuel mixture as well as the ignition, that is, the ignition angle of the combustion engine. In the handle 4, a throttle lever 13 is provided for operating the combustion engine by the user. A throttle lever lock 14 is assigned to the throttle lever 13.

The control unit 12 determines the operation of the drive motor independently of whether this drive motor is configured as a combustion engine or an electric motor.

Security circuit 20 communicates with the control unit 12 and the output signal 21 of the security circuit 20 is supplied to the control unit 12. As a practical matter, the control unit 12 is selectively switched into an operational-readiness state or into an out-of-service state by the output signal 21. The drive motor can go into an operational-readiness state in the operational-readiness state of the control unit 12. The drive motor is also in the out-of-service state in the out-of-service state of the control unit 12.

A read unit 15 is connected to the security circuit 20. The read unit 15 is preferably configured as RFID transmitter and receiving unit 18. Even other wireless transmitting technology such as Bluetooth, WLAN or the like can be practical.

The user must sign in at the security circuit 20 in order to take the work apparatus into service. This takes place via an operating code received via the read unit 15. In the embodiment shown, the operating code is stored on an access card 34 having an RFID-tag 35 and is read in by the read unit 15. For this purpose, the read unit 15 is embedded in the side wall of the housing 3. Accordingly, the RFID-tags 35, which are disposed in the proximity of the read unit 15, can be read out without difficulty.

When the read unit 15 receives an operating code, this code is transmitted via the signal line 16 to a test component 22. The test component 22 compares the read-in operating code to an operating code 24 stored in a memory 23. If the read-in operating code corresponds to the stored operating code 24, then output circuit 26 is driven via an operating output 25 in such a manner that the control unit 12 and therewith the drive motor 2 are transferred into an operational-readiness or standby state for operation. This operational-readiness state is practically maintained so long until the drive motor 2 is completely switched off by the user. In the case of an electric motor, the switch off is by a separation from the electric mains or the removal of a battery pack. In a combustion engine, for example, the actuation of a short circuit switch 17 takes place. If an operating code, which does not correspond to the stored operating code 24, is read in by the read unit 15, no enable switching takes place via the output signal 21. The control unit 12 and therewith the drive motor 2 remain in an out-of-service state.

If such a work apparatus is given up for service, the user need not hand over his access card 34 with the operating code. A service code 27 is stored in the security circuit in the memory component 23. A taking into service of the drive motor 2 for service purposes of the work apparatus is possible via the service code 27.

The read unit 15 transfers a service code to the test component 22, then this service code is compared to the service code 27 stored in the memory component 23. If the read-in code is identified as the stored service code 27, the test component 22 supplies a signal via a service output 28. This signal is supplied via a logic component 29 to the output circuit 26 which, in turn, switches the control unit 12 via the output signal 21 and therewith switches the drive motor into a standby state for operation. The user can then start and control the drive motor 2, for example, via the throttle lever 13.

The logic component 29 emits the signal to the service output 28 when and only then further when the counter count, which is announced by the counter 19, lies below a pregiven value. This value can be less than 5. In the embodiment, the value is set to "3".

The counter input 30 of the counter 19 lies on the service output 28 so that the counter 19 can increment its value by one step each time there is a signal to the service output 28. This means that the counter count of the counter 19 is "3" after a three-time sequential enable switching of the work apparatus via the service code. If the service code is read in a fourth time, an enabling signal is indeed again applied at the service output 28 and the value of the counter is incremented by "1"; however, the logic component 29 blocks the further transmission of this signal to the output circuit 26 because the counter count of the counter 19 is greater than the pregiven value "3". The work apparatus can then no longer be taken into operation via the service code.

In contrast, if the operating code, that is, the RFID-tag 35 remaining with the user or like authorization card 34, is read in at the read unit 15, the test component 22 issues an enable signal to the operating output 25 which switches the control unit 12 into an operational-readiness state and therewith also the drive motor 2.

The operating output 25 is switched to the reset input 31 of the counter 19 so that the counter 19 is reset when a signal is applied to the operating output 25. This means that after a taking into service via the authorized user by means of a permitted operating code, the security circuit anew permits three enabling circuits.

It can be practical to provide a time member 32 in the output circuit 26 which is started in each case by a signal to the operating output 25 or the service output 28. Practically, the time member 32 of the work apparatus is switched so as to be enabled for a pregiven time span, for example, the time span of a work day such as eight hours. With expiration at the time member 32, the output signal 21 is extinguished so that the control unit 12 goes into an out-of-service state. The work apparatus can then only be taken into service again when a permissible operating code or a permissible service code is read in anew.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

a work tool;

a drive motor for driving said work tool;

a security circuit for switching said drive motor into an operational-ready state for an operation or into an out-of-service state;

a receiver unit configured to receive a service code including a permissible service code and to output a signal;

said security circuit being configured to switch said drive motor into a temporary service state in response to said signal from said receiver unit when said service code received by said receiver unit is said permissible service code;

said security circuit including a counter arranged in said work apparatus for incrementing in response to each receipt of said permissible service code; and, after reading a pregiven counter count, said security circuit being configured to switch said drive motor into a permanent out-of-service state which can be revoked by receipt of a permitted operating code.

2. The portable handheld work apparatus of claim 1, wherein said pregiven counter count is less than 5.

3. The portable handheld work apparatus of claim 1, wherein said pregiven counter count is less than 3.

4. The portable handheld work apparatus of claim 1, wherein said receiver unit decrements said counter with each receipt of a permissible operating code.

5. The portable handheld work apparatus of claim 1, wherein at least one permissible service code and at least one permissible operating code are stored in said security circuit.

6. The portable handheld work apparatus of claim 1, wherein said temporary service state and the operational-readiness state are the same.

7. The portable handheld work apparatus of claim 1, wherein said drive motor is driven with at least one of a significantly reduced rotational speed and significantly reduced power in said out-of-service state.

8. The portable handheld work apparatus of claim 1, wherein said drive motor is switched off in said out-of-service state.

9. The portable handheld work apparatus of claim 1, wherein at least one of the full rotational speed and the full power of said drive motor can be called up in said operational-readiness state and in said temporary service state.

10. The portable handheld work apparatus of claim 1, wherein said drive motor is a combustion engine.

11. The portable handheld work apparatus of claim 1, wherein said work apparatus is a cutoff machine, a motor-driven chain saw, a brushcutter, or a blower apparatus.

* * * * *